US007806259B2

(12) United States Patent
Gregory et al.

(10) Patent No.: US 7,806,259 B2
(45) Date of Patent: Oct. 5, 2010

(54) SPORT BALL CONTAINER

(75) Inventors: Michael A. Gregory, Fairlawn, OH (US); Erik Eagleman, Danbury, CT (US)

(73) Assignee: Rubbermaid Incorporated, Huntersville, NC (US)

( * ) Notice: Subject to any disclaimer, the term of this patent is extended or adjusted under 35 U.S.C. 154(b) by 725 days.

(21) Appl. No.: 11/318,666

(22) Filed: Dec. 21, 2005

(65) Prior Publication Data

US 2006/0186000 A1 Aug. 24, 2006

Related U.S. Application Data

(60) Provisional application No. 60/637,723, filed on Dec. 21, 2004.

(51) Int. Cl.
*B65D 85/00* (2006.01)
*A47F 7/00* (2006.01)
*A47F 5/08* (2006.01)

(52) U.S. Cl. ..... 206/315.9; 206/806; 211/85.7; 211/87.01

(58) Field of Classification Search ..... 206/293, 206/315.1, 315.9, 579, 806, 816, 825; 220/480–482, 220/476, 489, 493; 211/14, 85.7, 90.03, 211/106, 112, 113, 119, 119.02, 119.09, 211/119.15, 119.16, 133.5, 181.1, 87.01; 482/131; 119/452, 459; 294/19.2
See application file for complete search history.

(56) References Cited

U.S. PATENT DOCUMENTS 698,226 A * 4/1902 Roberts ..... 294/19.2
1,007,477 A * 10/1911 Moscrip, Jr. ..... 220/493
3,371,795 A * 3/1968 Rosonke ..... 211/14
3,984,138 A * 10/1976 Brunner et al. ..... 294/19.2
4,214,684 A * 7/1980 Galowitz ..... 294/161
4,561,547 A * 12/1985 Estwanik, III ..... 211/14
4,993,548 A * 2/1991 Peterson ..... 206/315.1
5,823,360 A * 10/1998 Gorosave ..... 211/13.1
5,951,075 A * 9/1999 Green ..... 294/19.2
D432,012 S 10/2000 Roberts
6,158,593 A 12/2000 Olsen
6,663,119 B2 12/2003 White
2006/0124562 A1 * 6/2006 Simonetta Kurcheski .... 211/14

* cited by examiner

*Primary Examiner*—Mickey Yu
*Assistant Examiner*—Melissa L Lalli
(74) *Attorney, Agent, or Firm*—Dennis J. Williamson; Moore & Van Allen, PLLC

(57) ABSTRACT

A container for storing an article includes a base, a top, at least one upright, and an elastically deformable member. The top has an opening sized to permit an article to pass through the opening. The at least one upright extends between the base and the top. The elastically deformable member is shift able between a substantially undeformed position and a deformed position. The base, the top, the upright, and the elastically deformable member cooperate to form a storage cavity sized to store the article. The elastically deformable member and at least one of the uprights cooperate to form a gap sized to prevent passage of the article through the gap when the elastically deformable member is in the substantially undeformed position, and the size of the gap is expandable in response to deflection of the elastically deformable member to the deformed position to permit the article to pass through the gap.

7 Claims, 7 Drawing Sheets

FIG. 11
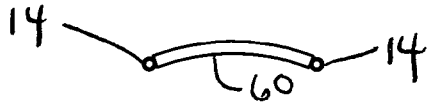
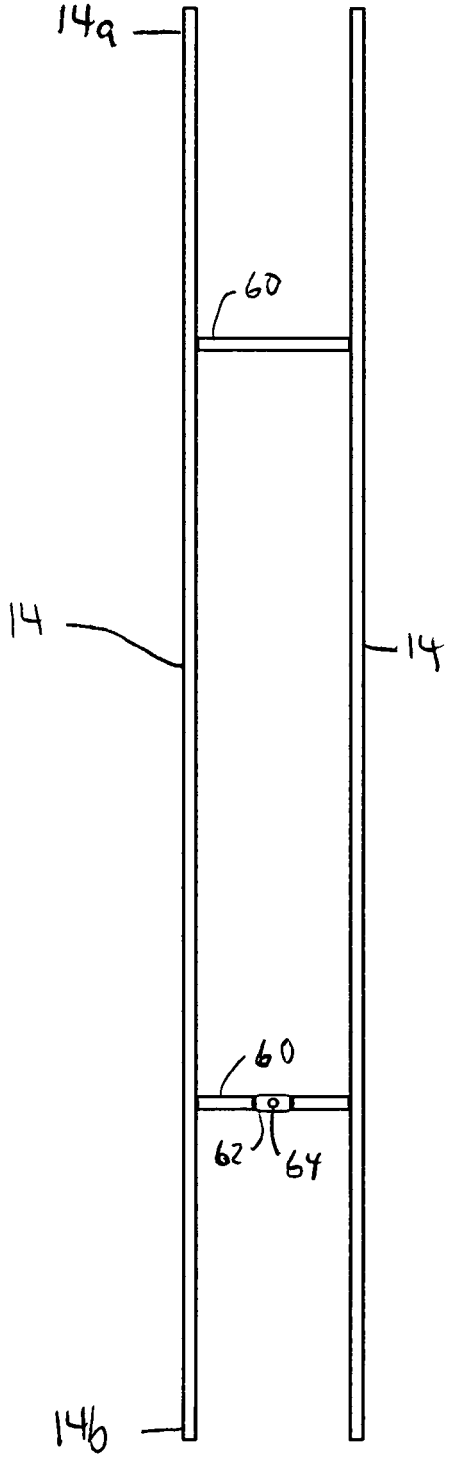
FIG. 9
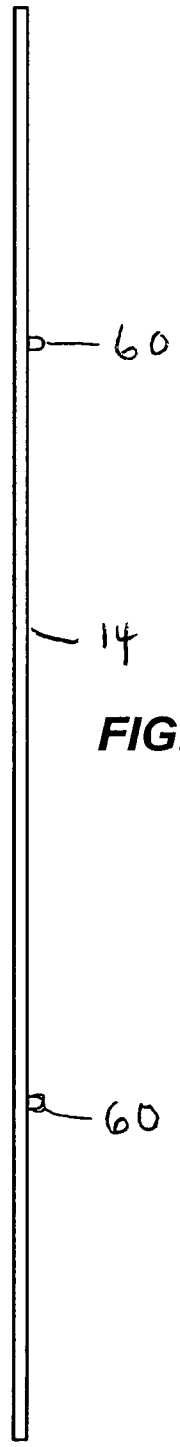
FIG. 10

SPORT BALL CONTAINER

CROSS REFERENCE TO RELATED APPLICATIONS

This application claims the benefit of U.S. Provisional Application No. 60/637,723, filed on Dec. 21, 2004.

BACKGROUND OF THE INVENTION

1. Field of the Disclosure

The present invention generally relates to a storage container, and more particularly to a storage container for sport balls and the like.

2. Description of Related Art

Storing sport balls is difficult for the typical homeowner, especially one with children. The options for storing sport balls such as footballs, basketballs, soccer balls, and the like, have traditionally been limited to large cardboard boxes, closets, or containers. A large box for storage not only takes up valuable floor space, but also forces one to dig through the box to find the particular ball that he or she desires. Because the balls are difficult to retrieve from the boxes, users dislike storing sport balls in this manner. Invariably, the balls end up laying on the floor of a garage, basement, or playroom. Typical homeowners tend to dislike a multitude of sport balls laying around on the floor.

BRIEF DESCRIPTION OF THE DRAWINGS

Objects, features, and advantages of a sport ball container in accordance with the teachings of the present invention will become apparent upon reading the following description in conjunction with the drawing figures, in which:

FIG. 9 shows a front view of a pair of uprights joined together by a pair of cross members and detached from the top and the base.

FIG. 10 shows a side view of the uprights.

FIG. 11 shows a top view of the uprights.

DETAILED DESCRIPTION OF THE DISCLOSURE

Figure 1:
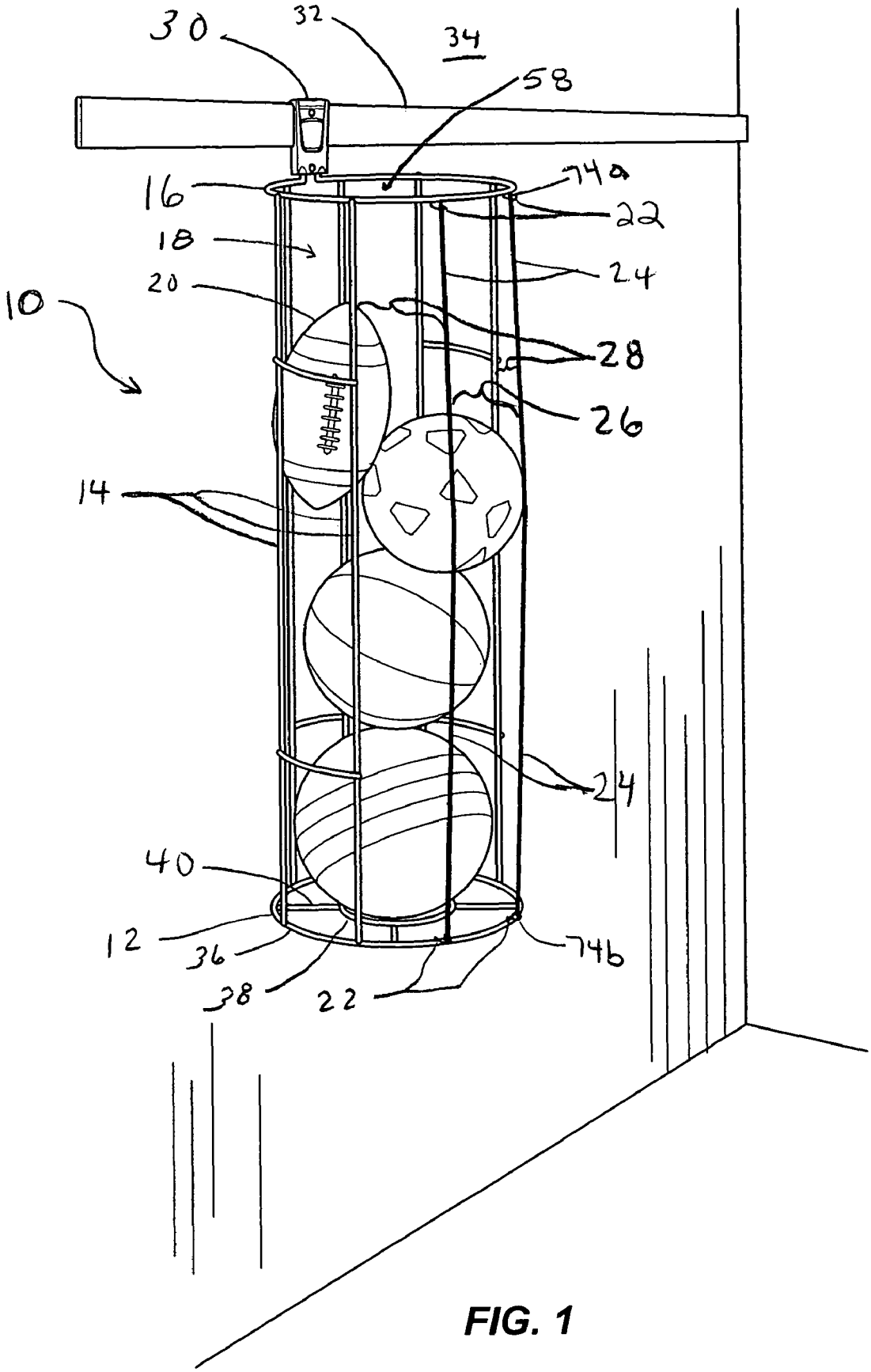
FIG. 1 shows a perspective view of a sport ball container attached to a wall.
Figure 2:
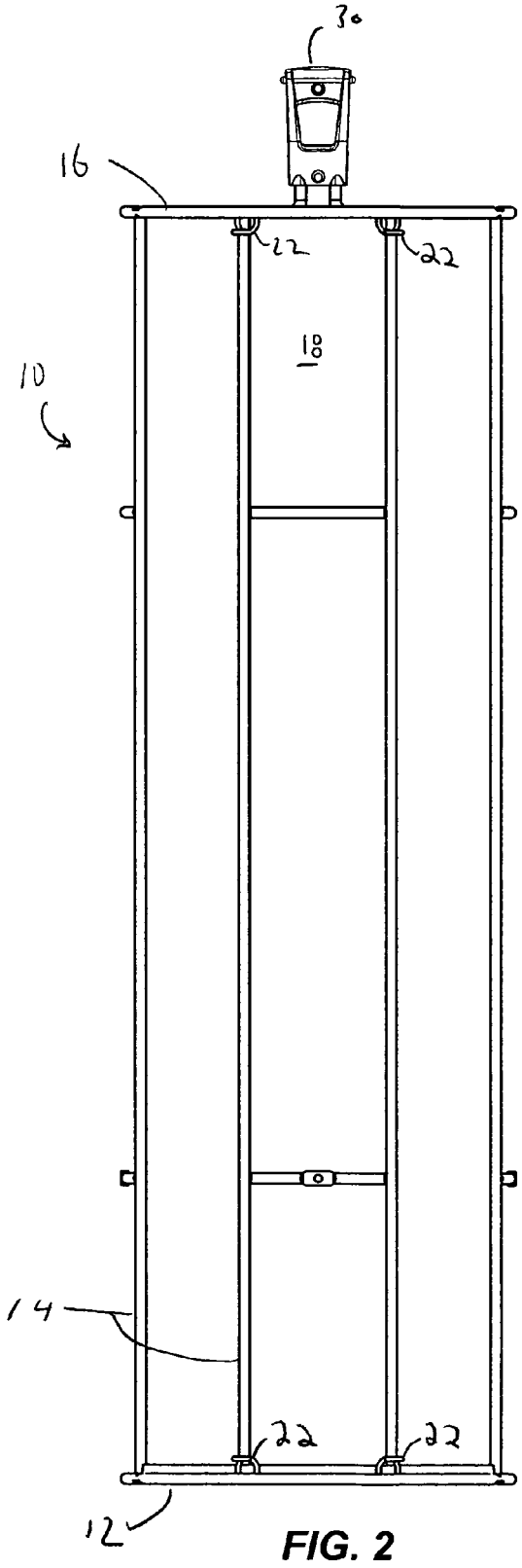
FIG. 2 shows a front view of the sport ball container with elastic cords removed.
Figure 3:
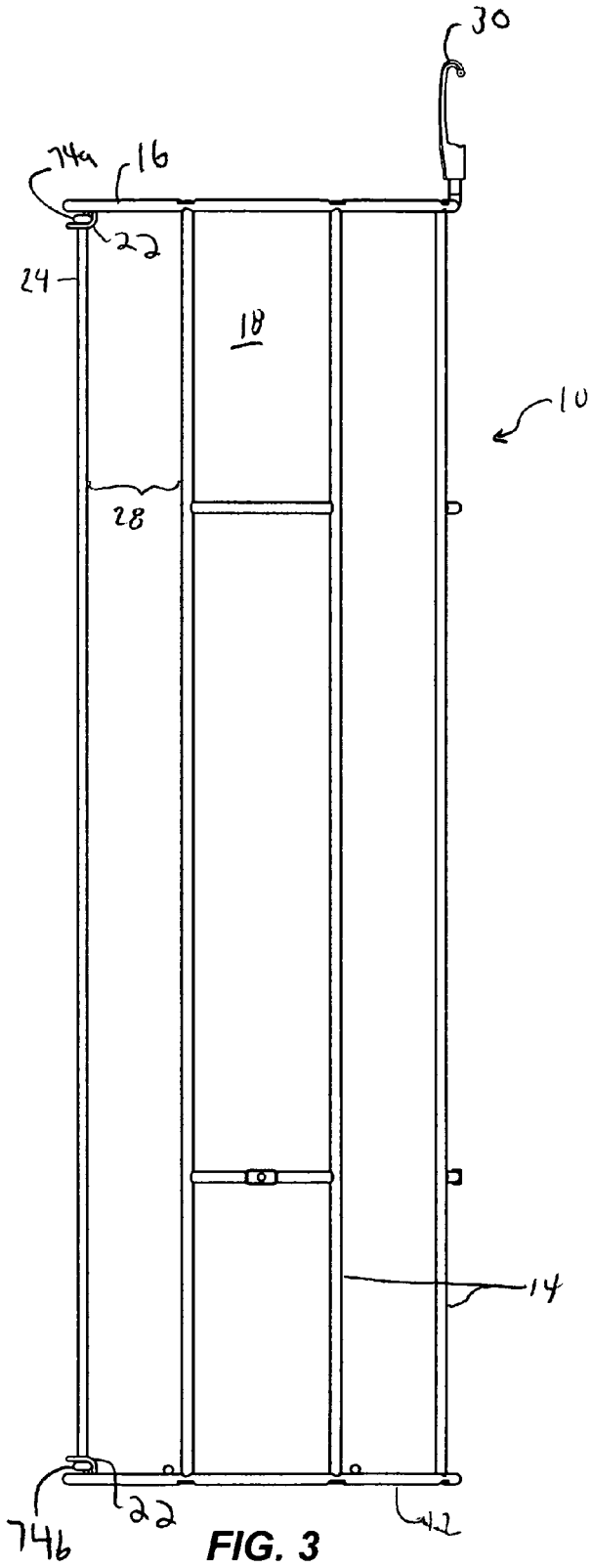
FIG. 3 shows a side view of the sport ball container with the elastic cords included.

Referring now to FIGS. 1-3, a first example of a sport ball container 10 is shown. The sport ball container 10 includes a base 12, a plurality of uprights 14, and a top 16. The uprights 14 extend from the base 12 to the top 16 to connect the top 16 to the base 12 in a spaced relation. The base 12, top 16, and the uprights 14 combine to define a storage cavity 18 of the container 10 in which sport balls 20 can be stored.

Both the base 12 and the top 16 include cord holders 22. A pair of elastic cords 24 are connected from the base 12 to the top 16 and secured at each end by the cord holders 22, as will be detailed herein. A first gap 26 is defined between the pair of elastic cords 24, and second gaps 28 are defined between the elastic cords 24 and the uprights 14. The elastic cords 24 are maintained with enough tension in a substantially undeflected or undeformed position to ensure that the sport balls 20 do not fall out of the storage cavity 18 by slipping through either the first gap 26 or the second gap 28.

The elastic cords 24 are also maintained in a state where a user can pull the cords 24 to a deflected or deformed position and expand either the first gap 26 or the second gap 28 (or both) so that a desired sport ball 20 can be removed from the storage cavity 18 through either the first gap 26 or the second gap 28. While the weight of the sport balls 20 in the storage cavity 18 will deflect or deform the elastic cords 24 slightly in the substantially undeflected or undeformed position, the elastic cords 24 have enough resiliency to retain the sport balls 20 in the storage cavity 18.

A hook 30 can be attached to the top 16. As shown in FIG. 1, the hook 30 can be used to secure the sport ball container 10 to a rail 32 mounted on a wall 34. Other hooks could be used to support the container 10 on a coat rack or any other suitable item. As will be noted herein, the container 10 can be secured to a wall in other ways.

Figure 5:
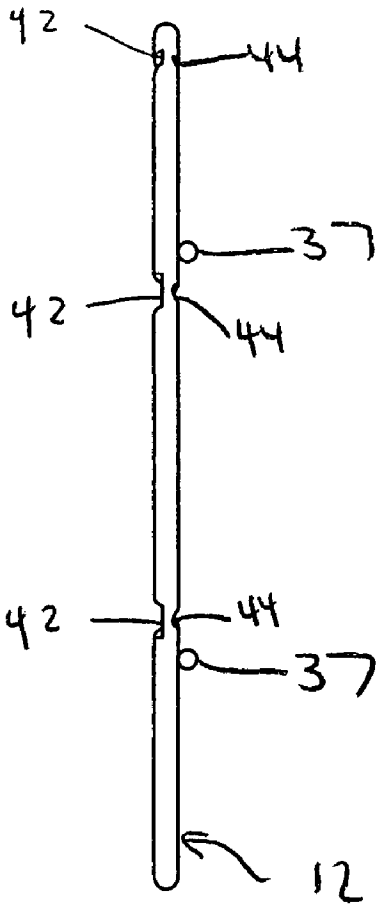
FIG. 5 shows a side view of the base of FIG. 4.
Figure 4:
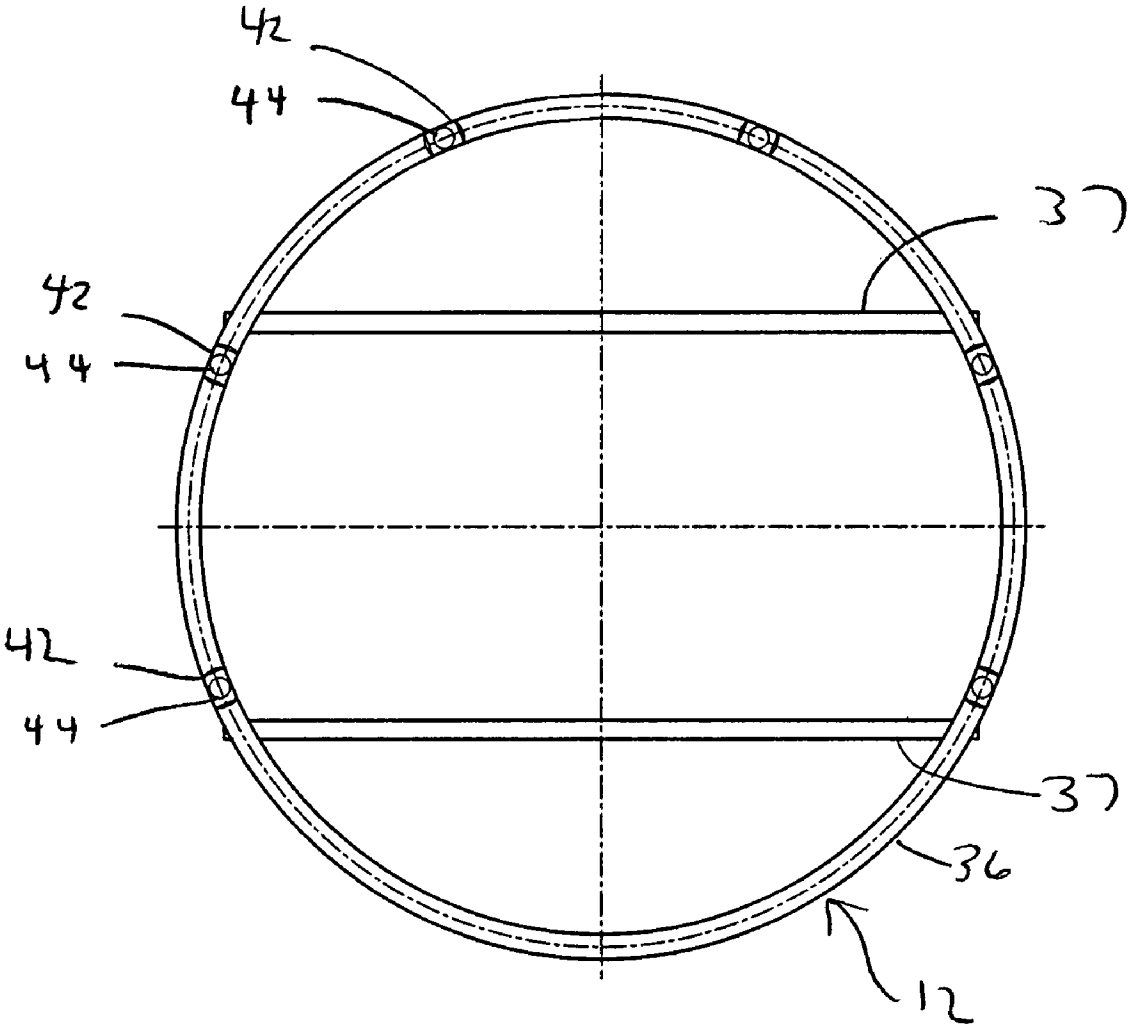
FIG. 4 shows a top plan view of a second example of the base of the sport ball container.

Referring now to FIGS. 4 and 5, the base 12 is shown. The base 12 includes an outer ring 36 and a pair of cross bars 37 disposed across the outer ring 36. The cross bars 37 can be mounted to the outer ring 36 in any known way, and here are spot welded. The cross bars 37 are spaced relative to the ring 36 so that the open spaces are small enough that the base 12 prevents a typical sport ball such as a basketball, soccer ball, or football from falling through the base 12.

In a second example of the base 12 shown in FIG. 1, the base 12 includes the outer ring 36 and an inner ring 38 spaced apart and connected by a plurality of radially disposed spokes 40. The space between the outer ring 36 and the inner ring 38 is small enough so that the base 12 prevents a typical sport ball from falling out of the container between the rings 36, 38. The diameter of the inner ring 38 is similarly sized to prevent a typical sport ball from falling through the inner ring 38.

Referring back to FIGS. 4 and 5, the base 12 includes a plurality of locations 42 that are prestamped such that the locations 42 are flat. Further, the flat locations 42 each include an aperture 44 that passes through the base 12. The apertures 44 permit threaded fasteners (not shown) to pass through and threadingly engage a corresponding upright 14.

The base 12 is described in first and second embodiments and is shown to be made of tubular metal. However, any shape, configuration, or material able to support sport balls would be acceptable. For example, a sheet, a board, a plate, woven strips, or any other structure is acceptable. Materials such as metal, plastic, wood, or the like are also acceptable. Further, the base 12 and outer ring 36 are shown as circular in the top view. The base 12 and outer ring 36 could also be rectangular, square, oval, or any other shape.

Figure 8:
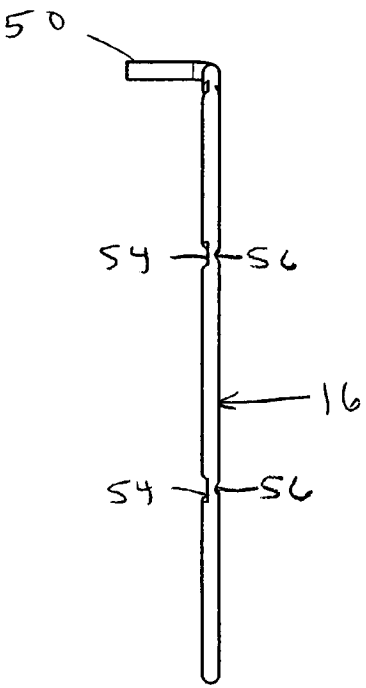
FIG. 8 shows a side view of the top.
Figure 6:
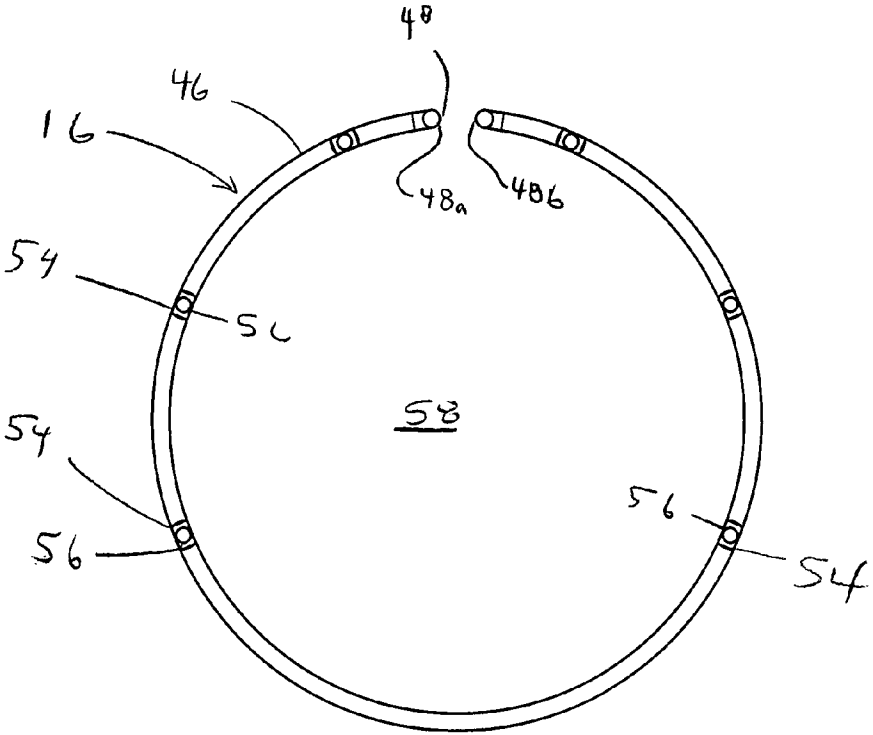
FIG. 6 shows a top plan view the top ring.
Figure 7:
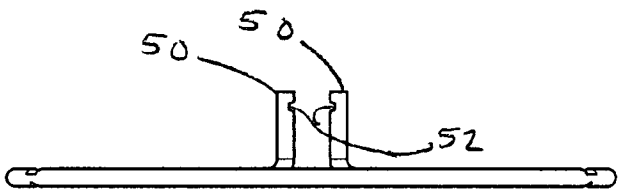
FIG. 7 shows a front view of the top.
Figure 13:
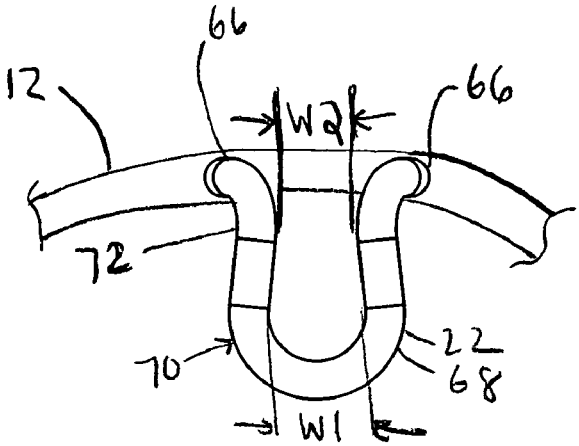
FIG. 13 shows a top view of the cord holder and a portion of the bottom.
Figure 15:
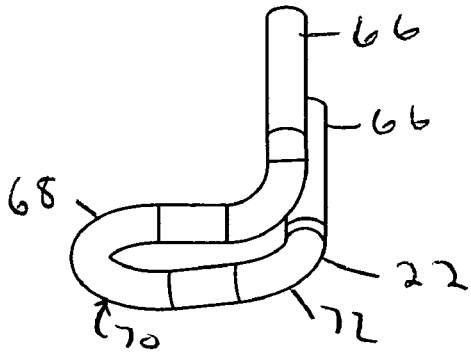
FIG. 15 shows a perspective view of the cord holder.
Figure 12:
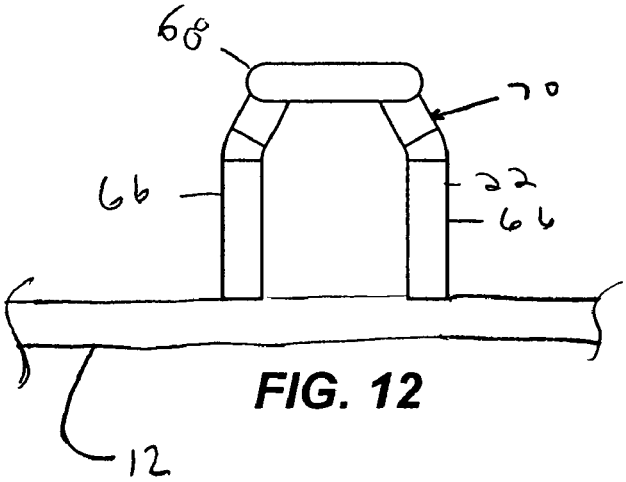
FIG. 12 shows an enlarged fragmentary front view of a cord holder.
Figure 14:
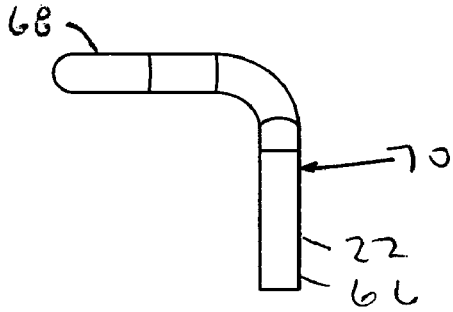
FIG. 14 shows a side view of the cord holder.

Referring now to FIGS. 6, 7, and 8, the top 16 is shown in several views. In this example, the top 16 is a ring 46 with a break 48 defining two endpoints 48*a*, 48*b*. A pair of prongs 50 extend upwardly from the endpoints 48*a*, 48*b* of the top 16. The prongs 50 include notches 52 and are adapted to connect the hook 30 to the top 16. Similar to the base 12, the top 16 includes several locations 54 that are stamped such that the locations 54 are flat. Apertures 56 are also formed in the flat locations 54 for threaded fasteners (not shown) to extend therethrough and engage with the uprights 14. The top 16 has an opening 58 inside the ring 46 that is sized to allow passage of sport balls from outside to inside the container 10 and inside the storage cavity 18.

The top 16 herein is shown as a broken ring 46 made of tubular metal with an opening 58. However, any shape, configuration, or material able to support sport balls and allow passage of sport balls into the storage cavity 18 of the container 10 would be acceptable. For example, a sheet, a board, a plate, woven strips, parallel strips, or any other structure with an opening is acceptable. Materials such as metal, plastic, wood, or the like are also acceptable. Further, the top 16 is shown as circular in the top view. The top 16 could also be rectangular, square, oval, or any other shape.

In another example, the top 16 is configured such that it does not include an opening and sport balls cannot enter the storage cavity 18 through the top 16. In this configuration, sport balls are both introduced into and removed from the storage cavity 18 through either the first gap 26 or the second gap 28.

A pair of uprights 14 are shown in FIGS. 9-11. The uprights 14 extend between the base 12 and the top 16 of the container 10 as previously described. The uprights 14 are preferably stiff or rigid, but in certain applications may be flexible. The uprights 14 are assembled in coupled pairs joined together by a pair of cross bars 60. The cross bars 60 can be mechanically attached to the uprights 14 with a threaded fastener or by welding and the like. The cross bars 60 can be arched and strengthen the structure of the container 10 by supporting the uprights 14. The cross bars 60 for each pair of uprights 14 can include a flat portion 62 and a through aperture 64. The cross bar 60 and aperture 64 function as a mounting bracket that permits a threaded fastener to extend therethrough and fasten the storage container 10 to a vertically disposed structure such as a wall.

Each upright 14 disclosed herein is made from tubular steel. Each end 14*a*, 14*b* of each upright 14 is internally threaded such that a fastener can be inserted through each of the apertures 44, 56 of the top and base 12, 16 and screwed into the threaded portion of the uprights 14 to secure the uprights 14 to the top and base 12, 16. Again, although the uprights 14 are shown as tubular steel, other materials, such as plastic, other metals, wood, or a composite can be used, and other methods can be used to connect the uprights 14 to the top and bases 16, 12. The uprights 14 should be strong enough to support the weight of the sport balls 20 or other articles stored in the container 10. While rigid uprights 14 are shown, other non-rigid uprights can also be used, such as rope, flexible plastic, or the like.

Referring now to FIGS. 12-15, a cord holder 22 is shown in several views. The holder 22 is generally in the shape of a wire loop 70 attached to the base 12. The holder 22 includes a pair of legs 66 and a flange 68 extending laterally out from the legs 66. The holder 22 has a first width W1 and further has a narrowed neck 72 with a width W2 that is less than the width W1. The flange 68 of the wire loop 70 can hold the elastic cords 24 in a fixed position, as will be described herein. A separate holder 22 is required for each end portion 74*a*, 74*b* of the elastic cord 24 as shown in FIGS. 1 and 3. While the wire loop 70 is shown to be arched, the loop can be other shapes such as rectangular, circular, or the like.

A plurality of holders 22 are disposed each on the top 16 and the base 12 as best shown in FIG. 2. The holders 22 are affixed to the top and base 12, 16 by any method known, but in this example are affixed by welding the legs 66 of a holder 22 to either the top or base 12, 16. The legs 66 extend laterally outward from either the top 16 or the base 12.

Figure 16:
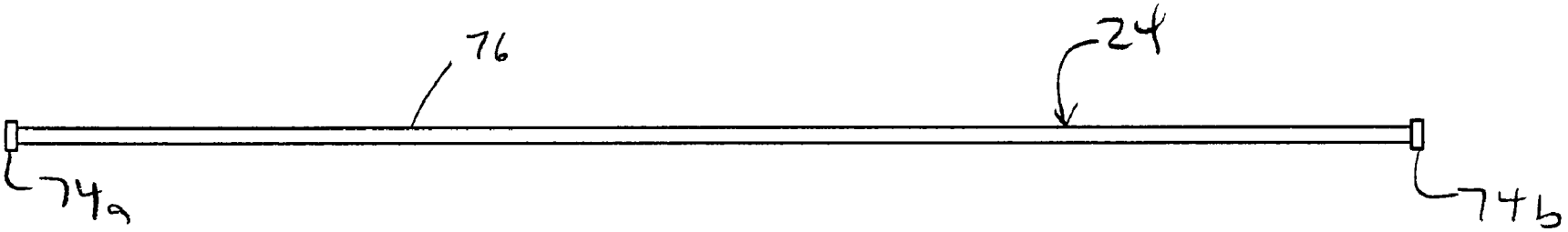
FIG. 16 shows a side view of an elastic cord of the sport ball container.
Figure 17:
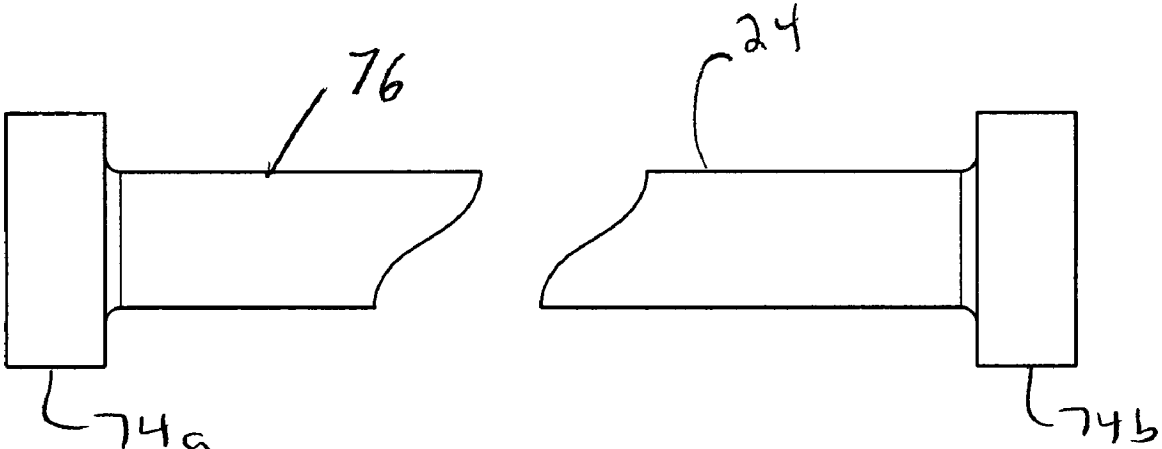
FIG. 17 shows an enlarged, broken side view of the elastic cord.
Figure 18:
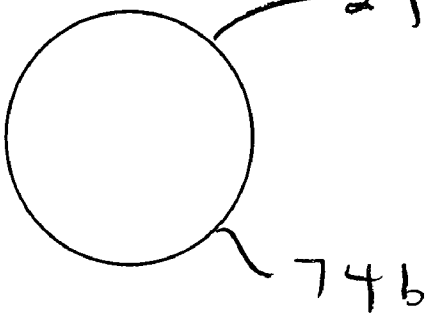
FIG. 18 shows an end view of the elastic cord.

Referring now to FIGS. 16-18, one of the elastic cords 24 is illustrated. The elastic cords 24 can be of the type commonly known as bungee cords. The elastic cords 24 are strong enough to prevent the balls 20 from falling through the first gap 26 and the second gap 28 when the cords 24 are in the substantially undeflected position, yet flexible enough to allow a user to stretch or deform the elastic cords 24 into the deflected position so that the first or second gap 26, 28 is enlarged enough to remove a ball from the container 10, without removing other ball(s). While an elastic cord 24 is shown, other elastically deformable members can be used.

The elastic cord 24 includes end portions 74*a*, 74*b* positioned on opposing ends of an elongate portion 76. The end portions 74*a*, 74*b* of the elastic cord 24 have a larger diameter than the elongate portion 76 so as to engage the flange 68 of the holder 22 to prevent the elastic cords 24 from moving from a fixed position relative to the storage container 10. To assemble an elastic cord 24 to a cord holder 22, the elongate portion 76 nearest the end portion 74*a* of an elastic cord 14 can be slipped through the neck 72 until the end portion 74*a* of the elastic cord 24 engages the wire loop 70. The wire loop 70 acts as a shoulder against the larger diameter of the end portion 74*a* such that the holder 22 maintains the end of the elastic cord 24. The process is repeated with the other end portion 74*b* of the elastic cord 24 and a cord holder 22 on the top 16. This can be seen best in FIG. 3.

The disclosed example of the sport ball container 10 can be placed on the floor, mounted directly to a wall, or attached to a horizontal rail on a wall. The sport ball container 10 is a convenient way for storing and retrieving sport balls 20. In this example, each ball 20 can be viewed from outside the container 10 and any one of the balls 20 can be retrieved without displacing other balls 20 as would be required with a box or the like. The sport ball container 10 can be shipped and stored in a disassembled condition to reduce the size of the shipping container, but can be assembled easily with one or more fasteners. The sport ball container 10 is simple and lightweight yet strong enough to hold several sport balls 20. The sport ball container 10 can be made from any suitable material such as metal, wood, plastic, or composite. In the example illustrated herein, the majority of the container 10 is formed of hollow steel tubing, but could also be formed of a solid wire construction.

To use the container 10, a user can insert a sport ball 20 through the opening 58 in the top 16 into the storage cavity 18. The ball 20 will fall by gravity to the base 12 or on top of another ball 20 previously stored therein. The balls 20 stay stored within the container 10 due to the tension in the elastic cords 24 maintaining the cords 24 in a substantially undeflected position and the rigidity of the uprights 14. Because the uprights 14 and elastic cords 24 are thin, the balls 20 stored in the container 10 can be visible to the user. A user may retrieve a ball 20 without having to pull the ball 20 through the opening 58 in the top 16. Instead, the user can deflect or deform an elastic cord 24 by pulling the cord 24 laterally outward to increase either the first gap 26 or the second gap 28, grasp the desired ball 20, and pull the ball 20 through the first or second gap 26, 28 and out of the container 10. This system can be advantageous in that generally all balls 20 stored in the container 10 are accessible, not just the ball 20 located closest to the opening 58 in the top 16. The system is also advantageous in that normally all balls 20 are visible, and therefore the user is not required to push the contents of the container 10 around to visually locate the desired ball 20.

Other sport ball containers can be constructed in accordance with the teachings herein. In one example, the plurality of uprights can be replaced with a single upright that is a large tube with an elongate slot running the entire length. Elastic cords can be disposed in the slot. In this example, the tube conceals the contents of the container, while still allowing access to the contents stored therein. This may be desirable for those who believe this would create a more aesthetic storage unit. The tube could also include designs, pictures, logos, or the like. In another example, the uprights are replaced with a plurality of elastic cords. In this example, the storage cavity would vary with the weight of the objects stored in the container. This example would allow variation in the storage cavity of the container and would allow the container to expand its storage capacity. Variations in the top and bases have been described earlier.

Furthermore, the generally disclosed size of the container can be changed depending on what is to be stored. For example, many games are played with balls that are smaller than basketballs, such as baseball, tennis, and golf. The overall dimensions of the container can be scaled larger or smaller to be suited to the contents which it is intended to store. Further, the container may be used to store virtually any items, and is not limited in its functionality to the storage of sport balls.

Although certain aspects of a sport ball container have been described herein, in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A wall-mountable sports ball container for storing sports balls, the sports ball container comprising:

a base comprising an outer ring;

a plurality of support members extending toward a center portion of the base;

a top comprising an outer ring, the top having an opening sized to permit a sports ball to pass through the opening;

a hook mounted adjacent a side portion of the outer ring of the top;

a plurality of parallel rigid uprights extending between the outer ring of the base and the outer ring of the top to maintain the base and the top in spaced apart relation;

a cross bar extending between at least two of the rigid uprights and comprising a mounting bracket;

a plurality of elastic cords extending between the outer ring of the base and the outer ring of the top, each of the elastic cords shiftable between an undeformed position in which the elastic cords are parallel to one another and a deformed position;

the base, the top, the rigid uprights and the elastic cords cooperating to form a storage cavity sized to store a sports ball, with the rigid uprights and the elastic cords cooperating to form a plurality of gaps;

the gaps sized to prevent passage of the sports ball through any one of the gaps when the elastic cords arc in the undeformed position, at least some of the gaps being expandable when a selected elastic cord is shifted to the deformed position to permit the sports ball to pass through the expanded gap;

wherein the mounting bracket and the hook are arranged to permit the container to be mounted directly to a vertical support surface; and including a pair of prongs extending vertically from the outer ring of the top, each of the prongs including a notch, the notches arranged to connect the hook to the outer ring of the top.

2. The sports ball container of claim 1, including a rail mountable to the vertical support surface, and wherein the hook is sized to engage the rail to thereby support the container from the rail.

3. The sports ball container of claim 1, wherein the elastic cords each include a pair of enlarged ends, and including a plurality of cord holders carried by the top and the base, the cord holders and the enlarged ends cooperating to permit the elastic cords to be releasably attached to the top and the base by passing the enlarged ends of the elastic cords through a widened portion of the cord holders.

4. The sports ball container of claim 3, wherein each of the cord holders comprises a wire loop, the widened portion formed by a portion of the wire loop.

5. The sports ball container of claim 4, wherein the wire loop includes a pair of spaced apart legs and a flange extending laterally from the legs, the flange comprising a narrowed neck expanding to hold the widened portion.

6. The sports ball container of claim 1, wherein the top and the base each include a plurality of flattened portions, each flattened portion having an aperture, and wherein each of the rigid uprights includes a pair of ends, each end secured to a corresponding flattened portion.

7. The sports ball container of claim 6, wherein each end of the rigid uprights is internally threaded and joinable to the corresponding flattened portion by a fastener.

* * * * *